US005116065A

United States Patent [19]

Ackerman

[11] Patent Number: 5,116,065

[45] Date of Patent: May 26, 1992

[54] ROTATING TABLE GAME

[76] Inventor: Timothy T. Ackerman, 14 Wilkenda Ave., East Haven, Conn. 06512

[21] Appl. No.: 601,933

[22] Filed: Oct. 19, 1990

[51] Int. Cl.[5] ..... A63F 9/00

[52] U.S. Cl. ..... 273/446

[58] Field of Search ..... 273/445, 446, 454, 455, 273/460, 280

[56] References Cited

U.S. PATENT DOCUMENTS

| | | | |
|---|---|---|---|
| 1,374,139 | 4/1921 | Denniss | 273/280 |
| 2,100,280 | 11/1937 | Goldberger | 273/280 X |
| 3,602,503 | 8/1971 | Schwartz et al. | 273/460 |
| 4,103,890 | 8/1978 | Treasarden | 273/455 |
| 4,300,762 | 11/1981 | Goldfarb et al. | 273/455 |

*Primary Examiner*—Paul E. Shapiro

[57] ABSTRACT

A table game comprising a stationary base and a rotating playing area. The playing area contains a plurality of buttons which can be pressed down. A playing card with a random arrangement of holes which lines up with the buttons lets the buttons contact an electrical grid if a hole is under a button. If there is no hole under a button, the button cannot contact the electrical grid. If the button does contact the electrical grid it completes a circuit. That circuit causes a projectile to be projected from the top of the playing area into the direction of the player. A timer is used that allows a set period of time for the player to choose a button before the projectile automatically projects. The timer and grid circuit can be closed only when the rotating playing area is pointing toward the player. When a player finishes his turn he quickly turns the playing area away from himself to open the electrical circuit before the projectile is projected at him.

1 Claim, 14 Drawing Sheets

ROTATING TABLE GAME

SUMMARY OF THE INVENTION

This invention is directed toward a table game which is intended to provide entertainment.

The rotating table game employs a stationary base with a rotating playing area. When the playing area is rotated in the direction of a player a microswitch closes and the players turn begins. Current passing through the microswitch is directed in two different paths. One path sends current to a three second delay timer, then to a solenoid activated pull rod assembly and buzzer to negative to complete the circuit. The pulling in of the pullrod assembly releases a spring operated flipper which propels a ball out of the top of the playing area in the direction of the player. The other path sends current to a grid and conductive disc switch area.

The grid and conductive disc switch area consists of a number of wire strips each running parallel to each other and every other one being connected at their ends. Current enters one connected set of wire strips. When the conductive disc comes into contact with the strips it passes the current from one set of strips to the other set of strips thereby closing the grid and conductive button switch. The current then passes to the solenoid activated pullrod assembly and buzzer to negative to complete the circuit. The pulling in of the pullrod assembly releases a spring operated flipper which propels a ball out of the top of the playing area in the direction of the player.

There are a number of conductive discs equally spaced from one another in the playing area. Each disc is held away from the grid by spring pressure. The discs are secured to the ends of finger operated buttons. Separating the conductive discs from the grid is a non-conductive gamecard. The gamecard has a random number of holes which permit the conductive disc to pass through it and contact the grid. The gamecard may have as little as 25% of the possible number of holes in it to as many as 75% of the possible number of holes in it. The more holes in the gamecard the more chance that pushing a button will close the grid and conductive disc switch. The gamecard may be inserted up, down or from either end, thereby giving more of a variety of gamecards. Gamecards are color coded to indicate the percentage of holes in the gamecard. One color indicates 25% of the discs will pass through the card and contact the grid. Another color indicates 50% of the discs will pass through the card and contact the grid. Another color indicates 75% of the discs will pass through the card and contact the grid. The more holes in the gamecard the harder it is to pick a button that won't make the ball fly out at the player. When a player picks a button that won't make its contact disc touch the grid, the player continues to push that button further until the outer piece of the button snaps in place. The player then turns the rotating playing area away from himself before the three second timer closes and activates the pullrod solenoid permitting the ball to be ejected.

Power is transmitted between the stationary base and the rotating playing area by the means of slip rings molded in the inside diameter of the base and brushes attached to the rotating playing area.

The rotating playing area is supported by rollers located in the base and is kept centered in the base by a circular lip extending up from the base into a recess in the rotating playing area.

The object of the game is for the player to choose a button within three seconds from when his turn begins and push the button, hoping it doesn't release the ball. He then has the remainder of the three seconds to turn the rotating playing area away from himself toward the next player, otherwise the timer will complete the circuit and the ball will be propelled toward him. Although there may be many different playing variations depending on player preference, the essence of the game lies in the operation of the game.

DETAILED DESCRIPTION OF THE INVENTION

Figure 1:
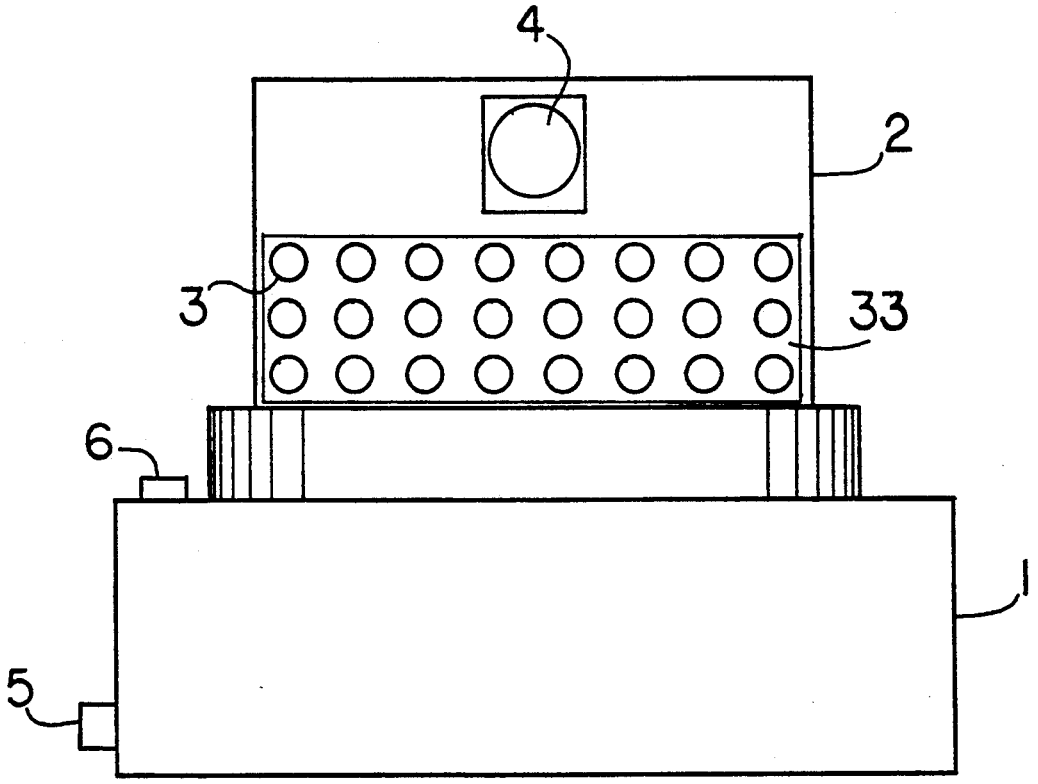
FIG. 1 is a front view of the invention.
Figure 2:
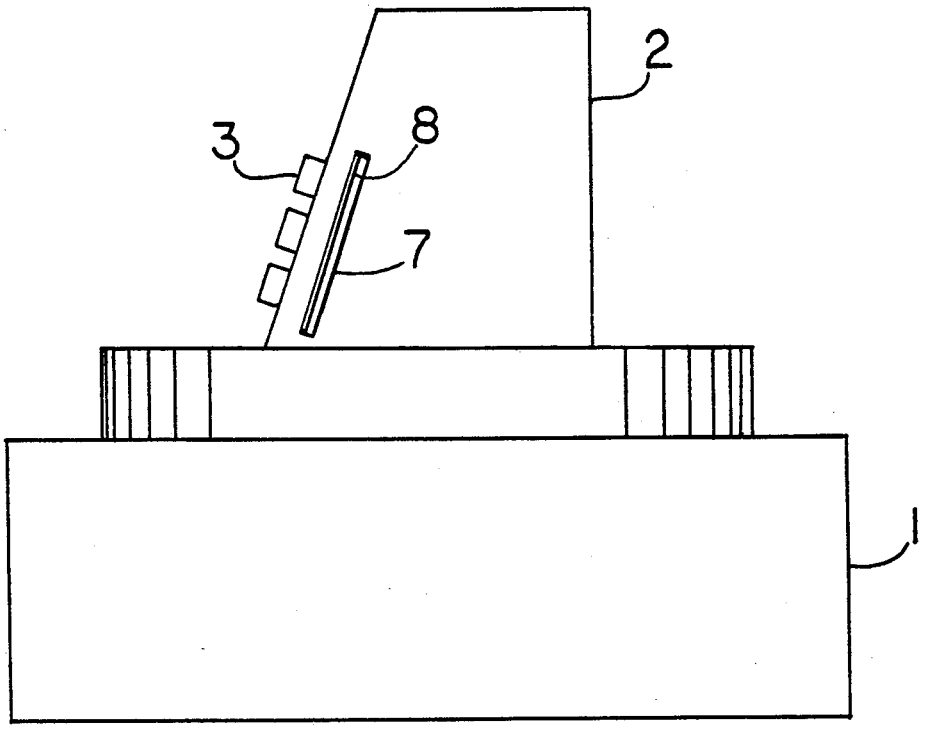
FIG. 2 is a side view of the invention.
Figure 3:
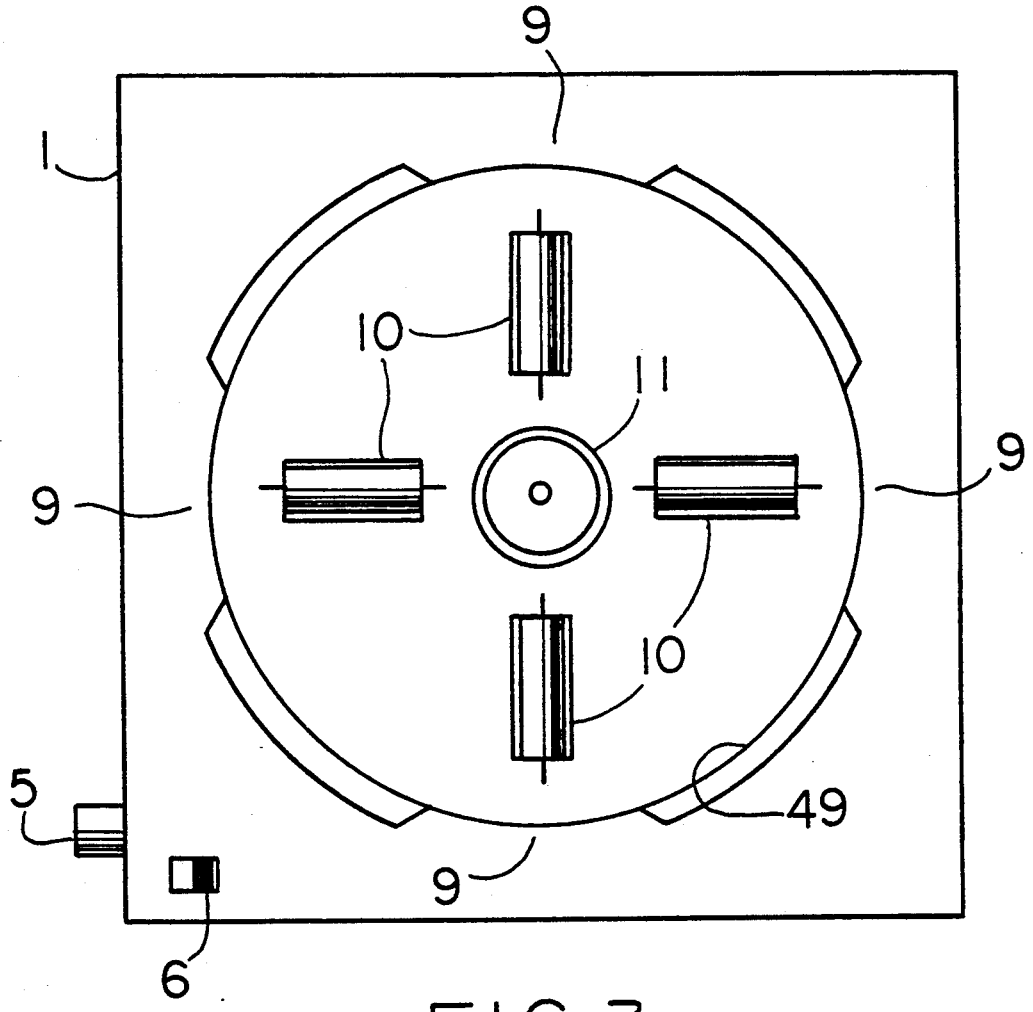
FIG. 3 is a top view of the inside of the stationary base.
Figure 4:
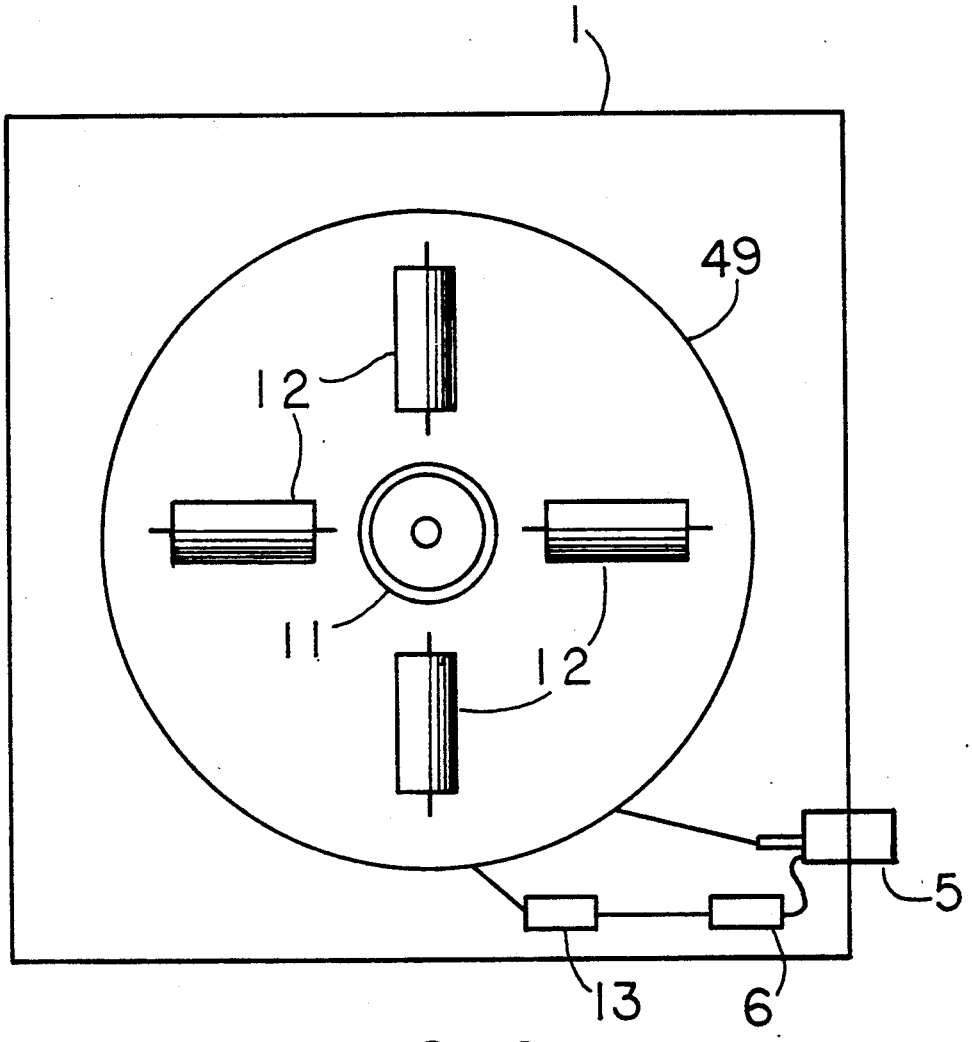
FIG. 4 is a bottom view of the inside of the stationary base.
Figure 5:
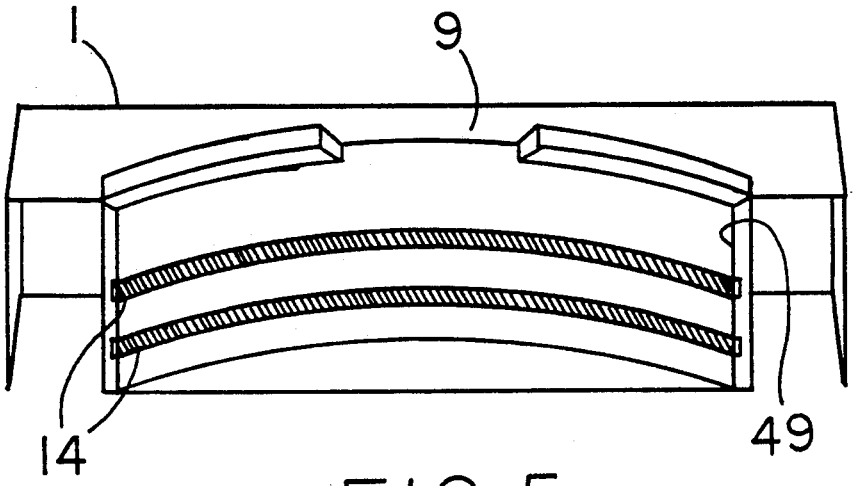
FIG. 5 is a cross section view of a portion of the stationary base.
Figure 6:
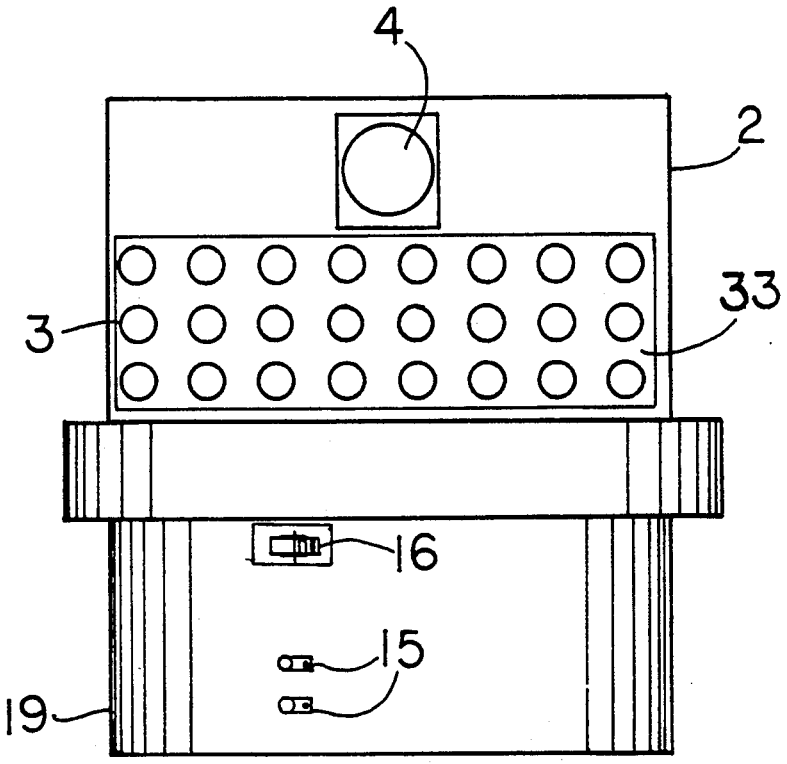
FIG. 6 is a front view of the rotating playing area assembly.
Figure 7:
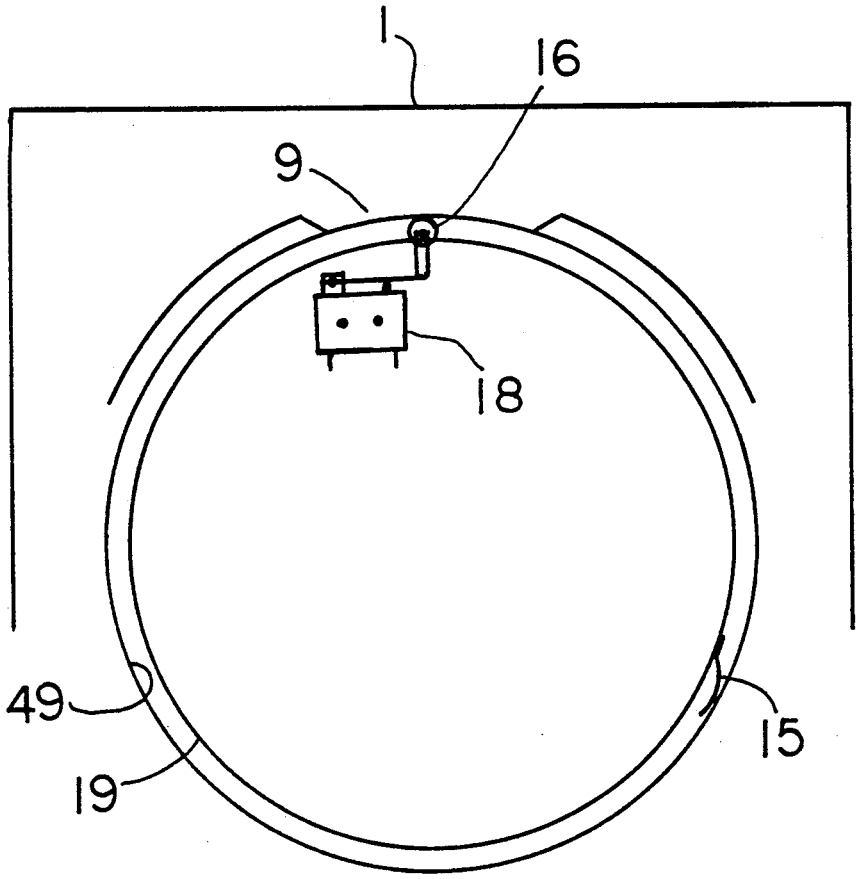
FIG. 7 is a view of the microswitch located in the rotating playing assembly in relation to an area of the stationary base which trips the microswitch.
Figure 8:
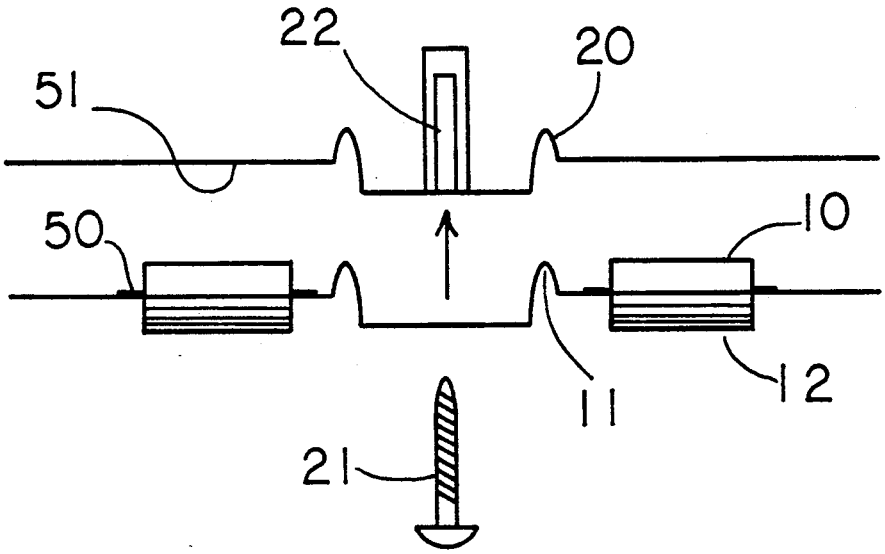
FIG. 8 is a view of the rollers which support the rotating playing assembly and the lip and recess centering device.
Figure 9:
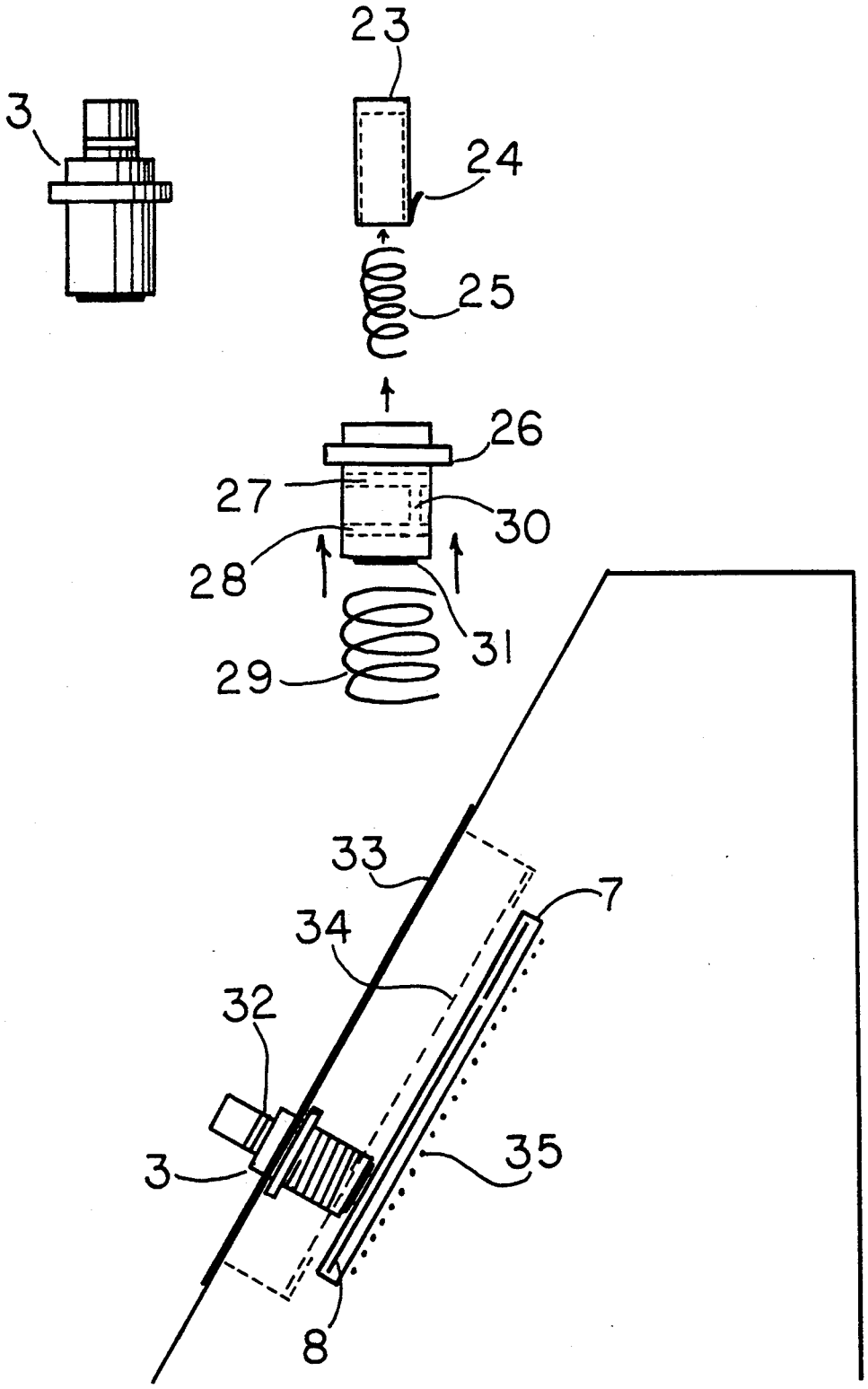
FIG. 9 is a view of a playing button assembled and disassembled and one of its positions in the rotating playing area.
Figure 10:
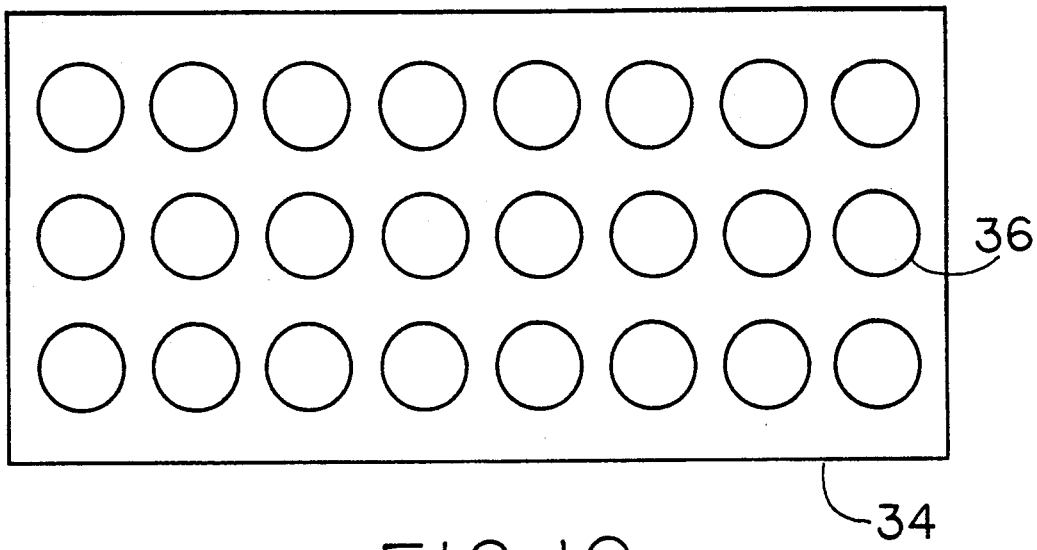
FIG. 10 is a view of the inner button retainer.
Figure 11:
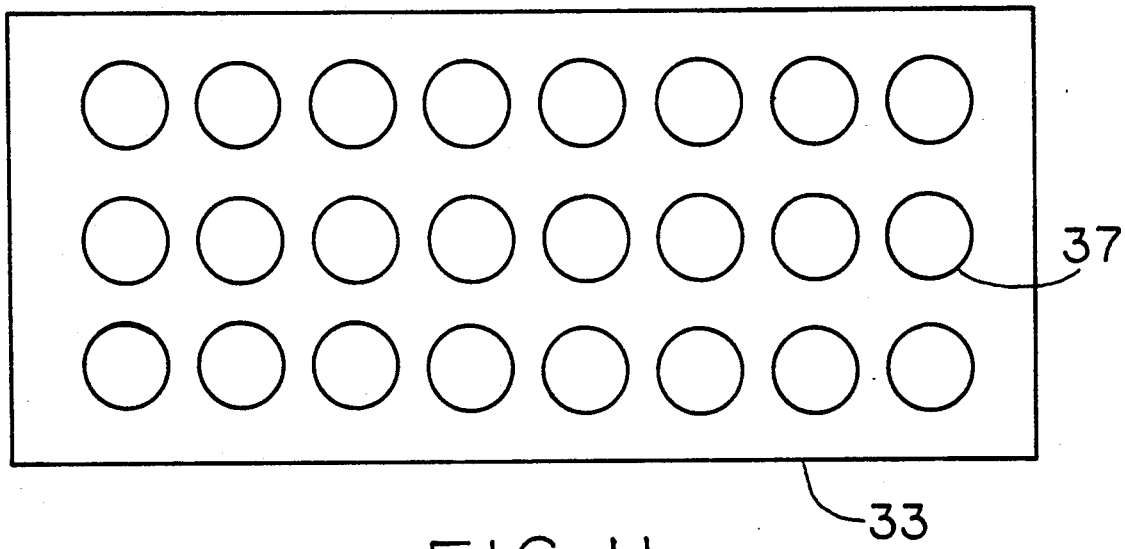
FIG. 11 is a view of the outer button retainer.
Figure 12:
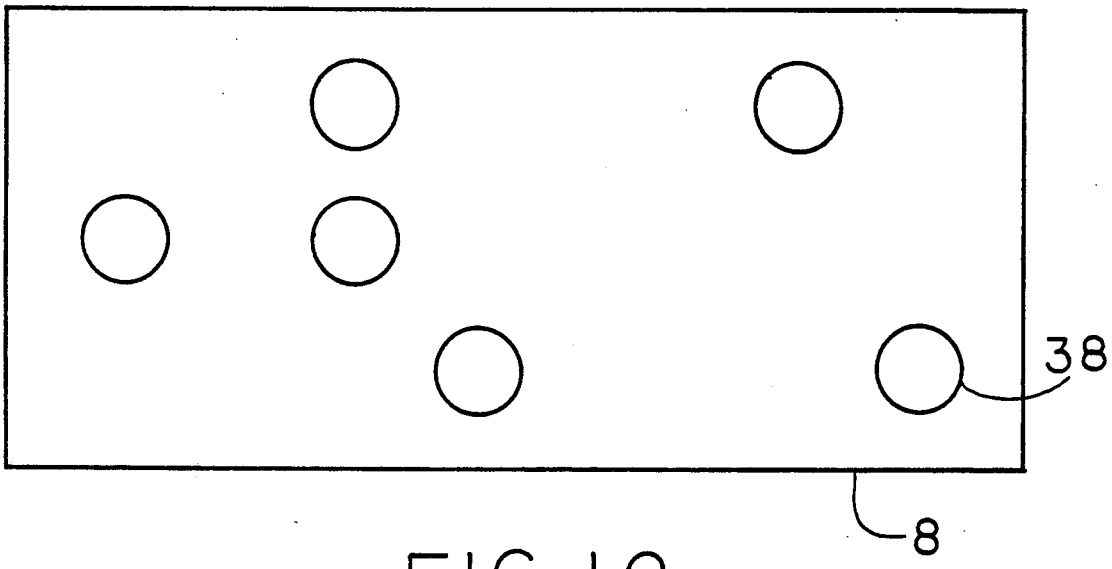
FIG. 12 is a view of a gamecard.
Figure 13:
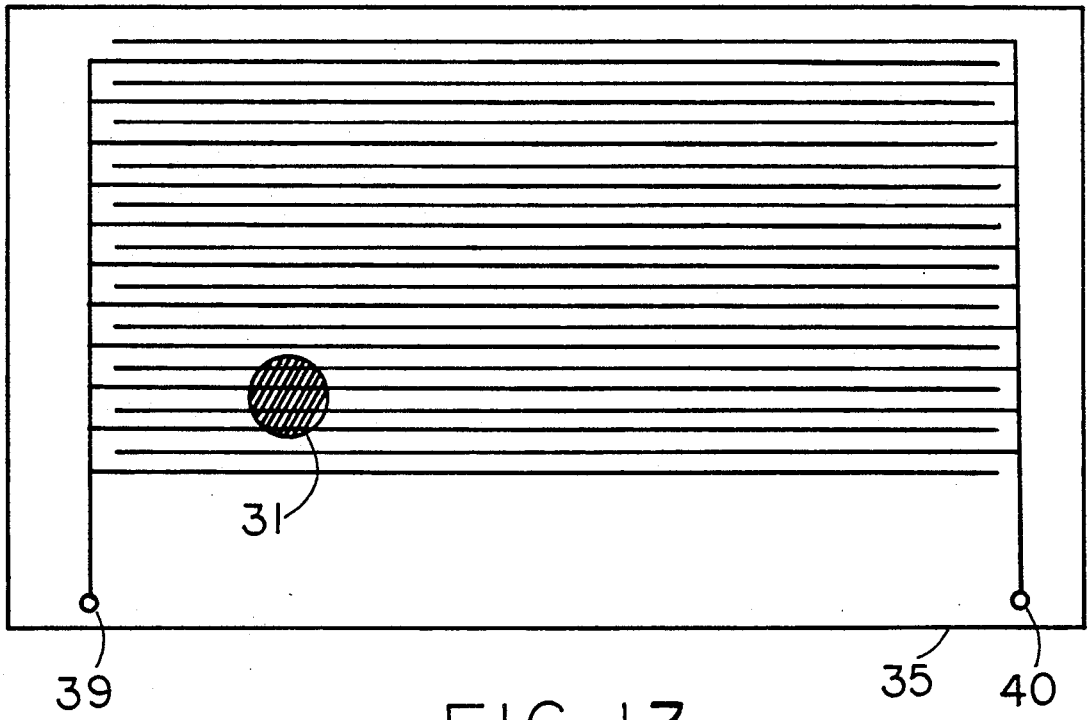
FIG. 13 is a view of the conductive disc and grid switch.
Figure 14:
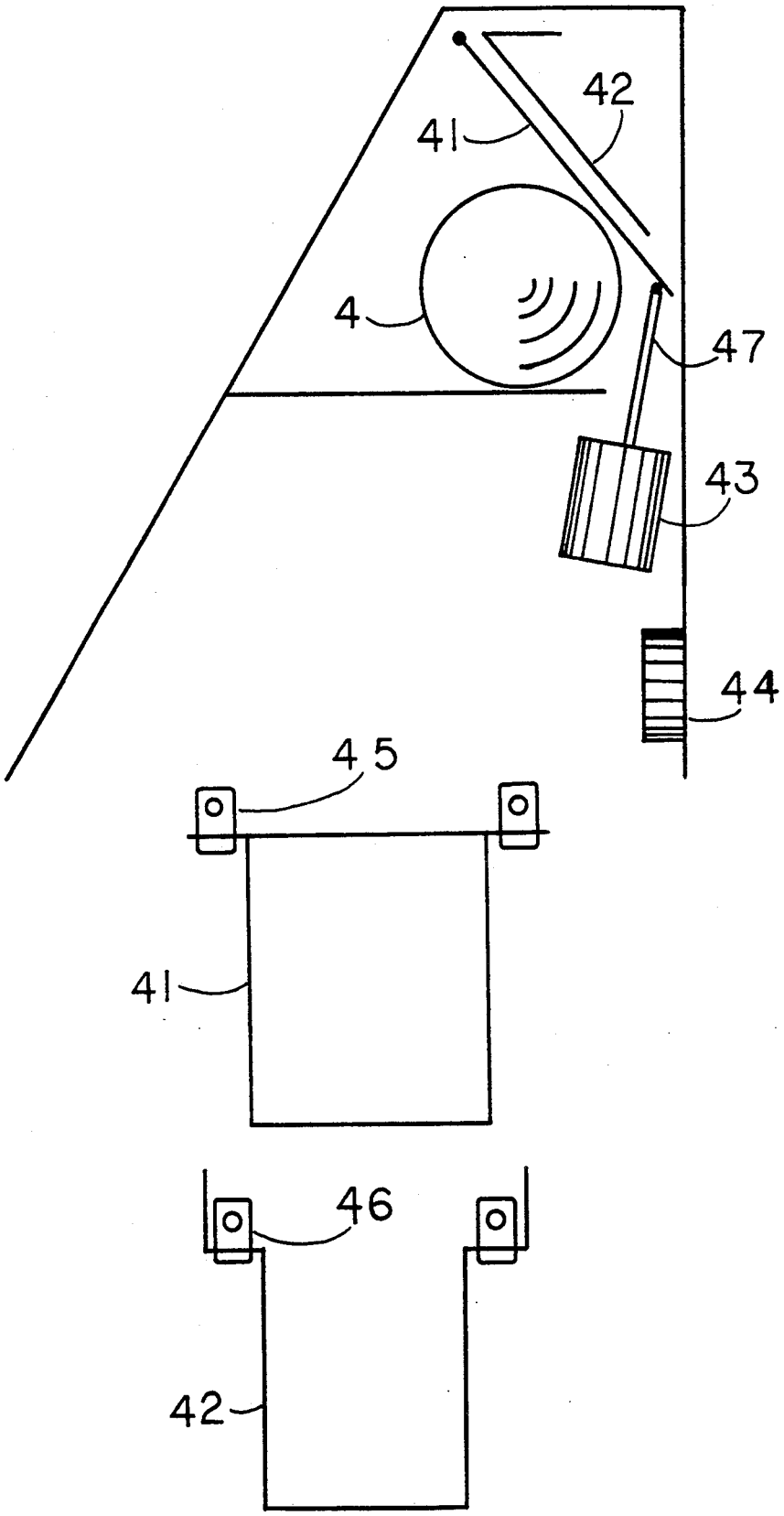
FIG. 14 is a view of the ball and flipper assembly and also a view of the flipper and the spring.
Figure 15:
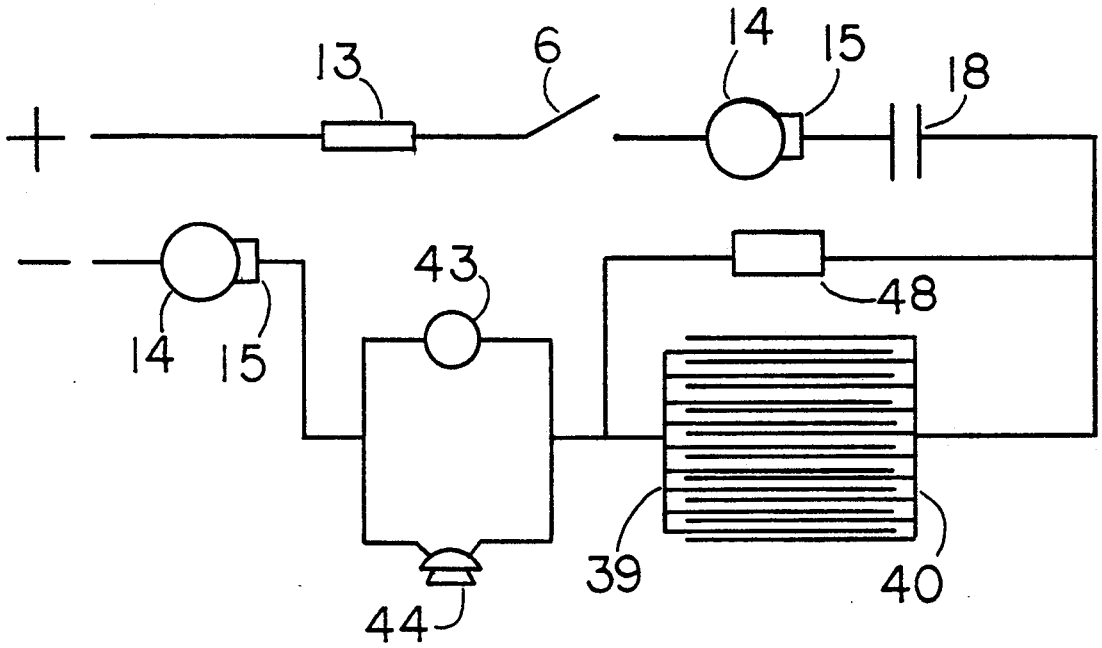
FIG. 15 is a wiring schematic of the invention.

Referring now to FIGS. 1–15:

The invention is made up of two main assemblies, the stationary base 1 and the rotating playing assembly 2. Power is supplied to the stationary base 1 by way of the power inlet 5. An on/off switch 6 controls power flow once supplied to the base. A fuse 13 protects the invention from shorting out. Located inside the stationary base 1 is a circular recess 49 extending from the top of the stationary base 1 to the bottom of the stationary base 1. Located on the inside face of the circular recess 49 are two slip rings 14. Power travels from the fuse 13 to one of the slip rings 14. Power is then transferred to the rotating playing assembly 2 by the means of brushes 15 which are located on the outside of the cylindrical base 19 of the rotating playing assembly 2. The brushes contact the slip rings 14 located on the inside of the stationary base. Power then goes to a microswitch 18 located inside the rotating playing assembly 2. The microswitch 18 remains open until its actuating roller 16 comes in contact with one of the protruding edges 9 of the stationary base 1. When the microswitch 18 closes it sends power in two different paths. One path sends power to a three second delay timer 48. If the microswitch 18 remains closed for three seconds the timer 48 closes and sends power to a buzzer 44 and a solenoid 43. The circuit is then completed through brush 15 and slip ring 14 and to the power receptacle 5.

Spring 42 holds pressure against flipper 41. Pullrod 47 holds the flipper 41 in the loaded position. When the solenoid 43 is activated it pulls in the pullrod 47 and permits the flipper 41 to push ball 4 out of its resting place in the direction of the player.

The other path sends power to the grid assembly 35. The grid assembly 35 is made up of two sets of conductive strips 39 and 40, each set of strips being joined at their ends and each set isolated from the other. A number of buttons 3 are situated on the front face of the rotating playing assembly. Each button is made of a plunger 23, inner spring 25, plunger retainer 26, outer spring 29 and conductive disc 31. The outer button retainer 33 contains a series of holes numbering the same amount as the number of buttons 3 and keeps the plunger retainer 26 in place in the rotating playing assembly 2. The inner button retainer 34 contains a series of holes numbering the same amount as the number of buttons 3 and keeps the plunger retainer 26 in place in the rotating playing assembly 2 by means of spring 29. The top of the plunger retainer 26 fits up through a hole in the outer button retainer 33. The bottom of the plunger retainer 26 fits through a hole in the inner button retainer 34. The spring 29 keeps the plunger retainer 26 pushed up towards the outer button retainer 33. The plunger 23 fits inside the plunger retainer 26. Spring 25 exerts pressure against the plunger 23 trying to force it out of the plunger retainer 26. Tab 24 snaps into channel 27 located inside the plunger retainer 26 and keeps the plunger 23 from coming out of the plunger retainer.

Located between the buttons 3 and the grid assembly 35 is the gamecard 8. The gamecard 8 is inserted into slot 7 in the rotating playing assembly 2. The gamecard 8 contains a number of holes 38 which line up with the buttons 3. The number of holes may vary between 25% of the total number of holes possible to 75% of the total number of holes possible. When a button 3 is pushed and the gamecard 8 area below it has a hole 38 the conductive disc 31 at the bottom of the button assembly 3 will pass through the gamecard 8 and contact the grid assembly 35. When the conductive disc 31 contacts the grid assembly 35 it passes the power from conductive strips 40 to conductive strips 39. Power then goes to the buzzer 44 and solenoid 43. The circuit is then completed through brush 15 and slip ring 14 and to the power receptacle 5. Spring 42 hold pressure against flipper 41. Pullrod 47 holds the flipper 41 in the loaded position. When solenoid 43 is activated it pulls in the pullrod 47 and permits the flipper 41 to push ball 4 out of its resting place in the direction of the player. If a button 3 is pushed and the gamecard 8 area below it does not have a hole the gamecard 8 will stop the movement of the plunger retainer 26. The player continues to push on the plunger 23 until the plunger 23 locks into the played position. This is done by tab 24 locking into channel 28 in the plunger retainer. Indicator strip 32 which is visible on the plunger 23 will not be visible when the plunger 23 locks into played position and this indicates to the players that this button has already been played.

The gamecard 8 is inserted in the rotating playing assembly 2 through the gamecard slot 7. The long sides of the gamecard 8 are the top and bottom. The short short sides of the gamecard 8 are the ends. The gamecard 8 may be inserted into the gamecard slot 7 either end first and either long side at the top or the bottom of the gamecard slot 7. This gives each gamecard 8 four different ways of being played.

The players turn starts when the player turns the rotating playing assembly 2 towards him so the playing buttons 3 face him. The trip areas 9 of the stationary base 1 line up with the players when the players sit at the invention facing the sides of the stationary base 1. As the player turns the rotating playing assembly 2 towards himself so that the buttons 3 face the player. The trip area 9 closes the microswitch 18 by hitting roller 16 of the microswitch 18 and actuating the microswitch 18. The microswitch 18 closes and the power is sent to the three second delay timer 48. The player must now choose a button to play. When a player chooses a button 3 and plays it one of two things happen. Either the button 3 the player chose will make the ball 4 eject and the buzzer 44 go off or the button 3 will be able to be pushed in fully and locked without the ball 4 ejecting and the buzzer not going off.

If the button 3 chosen by the player makes the ball 4 eject and the buzzer 44 go off the player can simply turn the rotating playing assembly 2 away from him so the roller 16 loses contact with the trip area 9 and the microswitch 18 opens. This cuts power to the solenoid 43 and buzzer 44. The ball 4 may then be reinserted into its resting place in the rotating playing assembly 2. This is done by pushing the flipper 41 back until it hits pullrod 47. The pullrod 47 is then pushed down by hand and the flipper 41 is pushed to the back of the ball resting area. The pullrod 47 is then released and it locks the flipper 41 into place. The ball 4 is then put back in its resting place in the rotating playing assembly.

If the button 3 played does not make the ball 4 eject the player must quickly turn the rotating playing assembly 2 away from himself so the trip area 9 will loose contact with the roller 16 and the microswitch 18 will open. This must be done before the timer 48 closes and sends power to the buzzer 44 and the solenoid 43, which will make the ball 4 eject. The next player then begins his turn.

The rotating playing assembly 2 is supported in the stationary base 1 by means of rollers 10. The bottom of the rollers 10 rest in roller recesses 12 in the bottom of the stationary base 1. The rollers are supported by pins 50. Area 51, located on the bottom of the rotating playing assembly 2 rests on rollers 10.

Lip 11 extends upward from the bottom of the stationary base 1 and reaches up into a recess 20 in the bottom of the rotating playing assembly 2, keeping the center of the stationary base 1 in line with the center of the rotating playing assembly 2. Screw 21 passes through a hole in the center of the stationary base 1 and threads into boss 22 to keep the rotating playing assembly 2 from lifting up away from the stationary base.

When a game is over the buttons are returned to their open position by rotating the plunger 23 so that tab 24 lines up with channel 30 in the plunger retainer 26. The plunger 23 will then push out until tab 24 engages channel 27 and the plunger stops its outward movement. The plunger is then rotated so that tab 24 is not in line with channel 30.

The spring 42 is held in place and pivots in clamps 46. The flipper 41 pivots on pins which are held in place by clamps 45.

The rotating table game may be played in several different ways. A player may be eliminated from the game as soon as he chooses a button which ejects the ball. Scores may be kept so that the person who reaches a certain number of buttons pushed that does not make the ball eject will win the game. A player may push as many buttons as possible without pushing one that will make the ball eject and push the rotating playing area away from him before the timer closes and the ball ejects. Variations of the playing of the game are up to the players.

While I have described my invention with particular reference to the drawings, such is not to be considered as limiting its actual scope.

Having thus described this invention, what is asserted as new is; I claim:

1. A reaction game comprising:

A) a rectangular base having a generally cylindrical recess having a first diameter formed therein, B) a rotating playing assembly mounted on said base having a cylindrical projection having a second diameter less than said first diameter, rotatably mounted in the recess of said base, C) two spaced slip rings fastened to the side surface of the recess in the base, D) two spaced brushes secured to the side of the projection, one brush aligned with and contacting each of the two slip rings, E) a plurality of equally spaced rollers mounted on the bottom of the recess and contacting the end of the projection to support the playing assembly rotatably on the base, F) means for holding said projection concentrically in said recess whereby the side of the projection is spaced equally from the side of the recess about its entire perimeter, G) four equally spaced protrusions extending inwardly of the recess from the side recess and aligned with the sides of the rectangular base, H) a normally open microswitch fixed to the projection and having a roller extending outwardly of the projection a distance out of contact with the side of the recess and sufficient to contact said protrusions upon rotation of said playing assembly whereby as said playing assembly is rotated said roller contacts and is pushed inwardly by said protrusions to close said microswitch, I) a grid assembly comprising two sets of conductive strips, each strip of each set being electrically connected to the other strips of the set and isolated from the strips of the other set, the strips being positioned on the playing assembly with the strips of one set spaced from and alternating with the strips of the other set, J) a plurality of push button assemblies on said playing assembly positioned in a pattern overlying different adjacent pairs of strips of said grid, each push button having a reciprocal contact normally spaced from but movable into contact with the two adjacent strips of the pair it overlies to electrically connect the strips of the pair, K) a removable card of non-conductive material removably positioned between said push buttons and said grid, said card having a pattern of through holes, large enough to pass a push button contact, underlying less than all said push buttons whereby the contacts of some of said push buttons may pass through said holes to contact the grid and others of said contacts are blocked by said card from contacting said grid, L) a projectile, M) an electrically actuated projector, mounted on said playing assembly aligned with said roller, for projecting said projectile and electrically connected to each set of strips, N) a source of electricity in said base connected through said slip rings and brushes to said microswitch and each set of strips, O) a timer means electrically connected to said projector and said microswitch for actuating said projector a set period of time after said microswitch has been closed unless said switch is opened before the end of said set period of time, P) whereby said playing assembly may be rotated to align said projector with one side of the base closing said microswitch and starting said timer, a player located at that side of the base may press one of said push buttons and then rotate said player assembly to align the projector with the next side of the base and if the push button selected by the player is aligned over one of the holes in the card, the contact electrically connects the pair of underlying strips and the projector is operated to project the projectile toward the player or if the player fails to rotate the player assembly before the set time period has passed, the timer actuates the projector to project the projectile.

* * * * *